United States Patent [19]

Bieri

[11] 4,026,602

[45] May 31, 1977

[54] APPARATUS FOR MECHANICALLY BREAKING UP STONE OR REINFORCED CONCRETE

[75] Inventor: Hans Bieri, Wohlen, Switzerland

[73] Assignee: H. Bieri AG, Liebefeld, Liebefeld, Switzerland

[22] Filed: Jan. 12, 1976

[21] Appl. No.: 648,138

[30] Foreign Application Priority Data

Jan. 31, 1975 Switzerland ..... 1152/75

[52] U.S. Cl. ..... 299/22; 299/23

[51] Int. Cl.[2] ..... E21C 37/02

[58] Field of Search ..... 299/21–23

[56] References Cited

UNITED STATES PATENTS

| | | | |
|---|---|---|---|
| 3,791,698 | 2/1974 | Darda | 299/23 |
| 3,883,178 | 5/1975 | Darba | 299/22 |

*Primary Examiner*—Ernest R. Purser

*Attorney, Agent, or Firm*—Cantor and Singer

[57] ABSTRACT

An apparatus designed especially for mechanically breaking up reinforced concrete and comprising a cylinder containing a hydraulically-operated piston connected to a thrust wedge and acting upon two insertion pieces to be inserted in a borehole in the reinforced concrete or in stone. In order to avoid excessive wear and tear on the components by reducing the stresses to which they are subjected, the apparatus comprises a bracing part rigidly joined to the cylinder by tie plates, and the two end faces of the insertion pieces remote from the cylinder are braced against this bracing part, through which the thrust wedge passes when the apparatus is in operation. Thus the end faces of the insertion pieces can slide on the surface of the bracing part when they are driven apart by the advancing wedge.

3 Claims, 4 Drawing Figures

APPARATUS FOR MECHANICALLY BREAKING UP STONE OR REINFORCED CONCRETE

Figure 1:
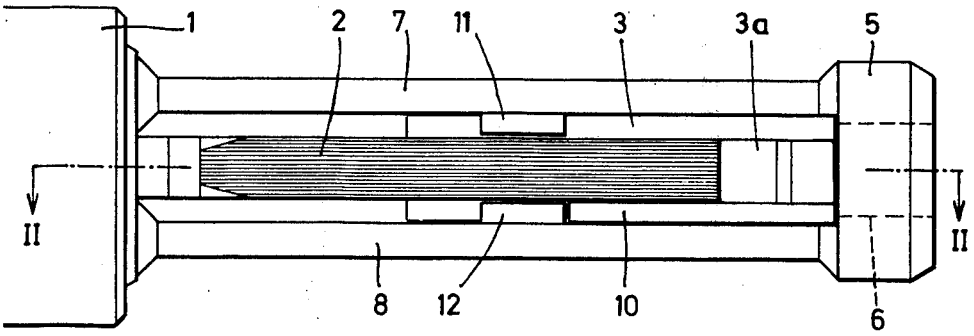

This invention relates to an apparatus for mechanically breaking up stone or reinforced concrete, the apparatus comprising a cylinder, a hydraulically-operated piston disposed for longitudinal movement within the cylinder, a piston rod, a thrust wedge connected to the piston by the piston rod, and two symmetrically-disposed insertion pieces adapted for insertion into holes bored in the stone or concrete and each comprising an inclined portion having the same angle of inclination as the wedge, the insertion pieces being movable away from one another laterally and being secured against longitudinal displacement, and the piston being adapted to act upon the insertion pieces via the wedge. By means of bearing parts fixed to the inner ends of the insertion pieces, the latter are hung within a casing which is integral with the cylinder and which also serves to guide the piston rod.

Apparatus of this kind meet various requirements. Among other things, they should be portable and capable of producing very great bursting forces, on the order of some hundreds of megapoundals, by means of the insertion pieces; moreover, even those components which are subjected to the greatest stresses, especially the insertion pieces, should be resistant to breakage.

In an apparatus taught by Swiss Pat No. 454,003, the insertion pieces are suspended by their rearward ends, so as to be laterally displaceable, on a crossbolt inserted in a casing which is integral with the cylinder and also serves to guide the piston rod. Such crossbolts are subjected to great beding stresses when the apparatus is in operation.

In an apparatus of the kind initially mentioned which is described in the same Swiss patent as well as in German Pat. No. 1,249,194 (in which reference is also made to a great deal of other prior art), the insertion pieces are provided at their inner ends with substantially half-round, reinforced head portions slidingly seated on a collar which is reinforced with a hardened ring in the area of the contact surface and disposed at the lower end of the casing.

In this design, the bearing pressure on the contact surfaces is extremely high because these surfaces are so small, one reason for this being that in this apparatus, intended for breaking up stone or rock, the aim was to be able to insert the insertion pieces in boreholes having as small a diameter as possible, which in turn led to correspondigly small dimensions of the apparatus.

In this known design, in order to prevent the head portions from canting in the bearing ring, the head portions must slide transversely. However, such transverse sliding takes place only if the slide supports between the thrust wedge and the insertion pieces reach back over the entire stroke of the thrust wedge to the transverse plane containing the contact surfaces between the head portions and the bearing ring. Yet even if this prerequisite is met, it may happen that the transverse sliding of the head portions toward each other does not take place when the thrust head is retracted, even though the stone or rock acts upon the insertion pieces at a certain distance from the bearing ring, e.g., under the effect of weight or—when reinforced concrete is being broken up—through the resilient reaction of non-ripped reinforcing bars. Whenever the transverse sliding does not take place in one or the other direction, canting occurs at the contact surfaces. Canting also takes place when the insertion pieces slip out of line under the influence of shearing stresses acting in the reinforced concrete. Whenever canting occurs, bending may easily lead to damage which can put the apparatus out of order.

It is an object of this invention to provide an apparatus of the kind initially described, especially for breaking up reinforced concrete, which is designed in such a way that it not only meets the above-stated requirements but also obviates the shortcomings of the known apparatus just mentioned.

To this end, the apparatus according to the present invention further comprises a bracing part, a passage in the bracing part for the wedge, and two tie plates respectively extending on each side of the wedge, the bracing part being rigidly joined to the cylinder by the tie plates, and the insertion pieces each having a flat end face at the end thereof remote from the cylinder, these end faces being braced against the bracing part.

In a design such as this, the specific compression between the flat bracing faces of the insertion pieces and the associated surfaces of the bracing part is reduced to such an extent that there need be no fear of premature wear and tear, much less of erosion. What is more, no harmful canting can occur since the insertion pieces are freely movable in the transverse direction.

Preferably, the insertion pieces will have a T-shaped cross-section, the upright of the T comprising the inclined portion and a slide plate being secured to one side of each such upright and displaceably guided along the inside of an adjacent tie plate.

Furthermore, it may be provided that on each insertion piece, the slide plate extends up to the front end thereof and back to a stop ledge secured to the inside of the adjacent tie plate.

Figure 2:
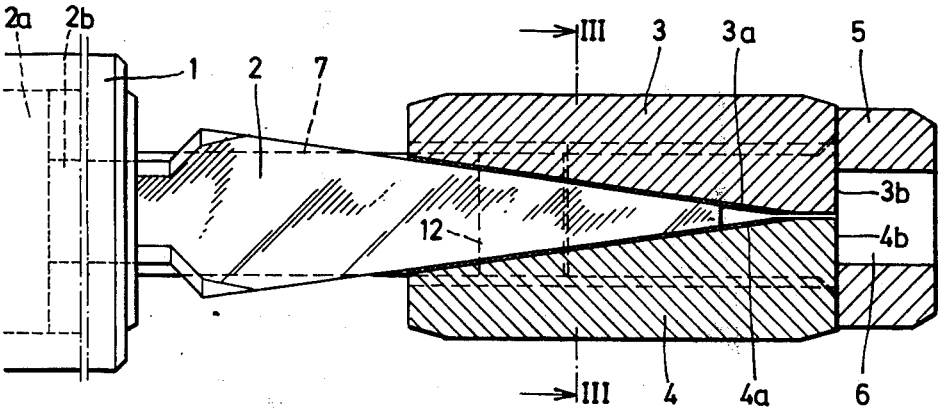
Figure 3:
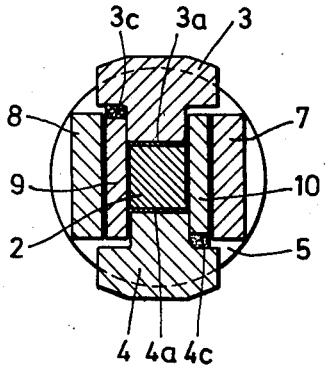
Figure 4:
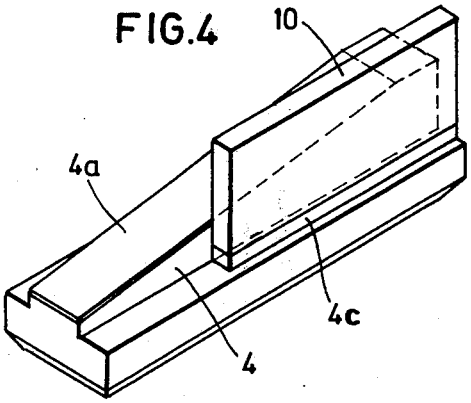

A preferred embodiment of the invention will now be described in detail with reference to the accompanying drawing, in which:

FIG. 1 is an elevation of the apparatus, with one insertion piece being omitted, FIG. 2 is a longitudinal section taken on the line II—II of FIG. 1, FIG. 3 is a cross-section taken on the line III—III of FIG. 2, and FIG. 4 is an isometric view of one of the two insertion pieces.

Reference numeral 1 designates a cylinder, shown only in part, in which a hydraulically-operated piston 2*a* is disposed for longitudinal movement. The piston is connected via its piston rod 2*b* to a thrust wedge 2 which acts upon two symmmetrically-disposed insertion pieces 3, 4 to be inserted in a borehole in the stone or concrete to be broken up. Insertion pieces 3, 4 can be driven apart laterally and each comprise an inclined portion having the same angle of inclination as wedge 2, each such portion being provided with a slide surfacing 3*a* and 4*a*, respectively, made of bronze or the like; the flat, transversely-lying end faces 3*b* and 4*b* of insertion pieces 3, 4 each form a sliding surface which is braced against a corresponding surface of a bracing part 5. The latter has a passage 6 for wedge 2 and is rigidly connected to cylinder 1 by two tie plates 7, 8 extending parallel to the longitudinal axis of wedge 2 on each side thereof.

As may best be seen from FIGS. 3 and 4, insertion pieces 3, 4 are T-shaped in cross-section, the upright of the T comprising the inclined portion together with the slide surfacing 3*a* or 4*a*. Secured to one side of each insertion piece 3, 4, e.g., welded thereto (the welding seams being designated as 3*c*, 4*c*, is a slide plate 9, 10 which is displaceably guided along the inside of the adjacent tie plate 7, 8. Welded to the inside of each tie plate 7, 8, approximately midway along its length, is a stop ledge 11, 12, against which slide plate 9, 10 of the corresponding insertion piece 3, 4 comes to rest when wedge 2 is retracted, so as to prevent insertion pieces 3, 4 from being pulled back upon retraction of wedge 2.

The mode of operation of the apparatus will be obvious from the foregoing description thereof and requires no further explanation. It may be worthwile to mention, however, that before the illustrated operative portion is introduced into a borehole in the stone or concrete to be broken up, the two insertion pieces may be removed without any difficulty, all parts easily cleaned, and the sliding surfaces coated with a lubricant. In none of the components do any stresses arise which would be difficult to take into account. The transverse path which the insertion pieces can travel is very long as compared with the known designs, which is an important factor particularly in the mechanical breaking-up of rather lean reinforced concrete because there, a long such path is often necessary until ripping of the reinforcement takes place.

What is claimed is:

1. An apparatus for mechanically breaking up stone or reinforced concrete, said apparatus comprising a cylinder, a hydraulically-operated piston disposed for longitudinal movement within said cylinder, a piston rod, a thrust wedge connected to said piston by said piston rod, and two removable symmetrically-disposed insertion pieces adapted for insertion into holes bored in said stone or concrete and each comprising an inclined portion having the same angle of inclination as said wedge, said insertion pieces being freely movable away from one another laterally and being secured against longitudinal displacement, and said piston being adapted to act upon said insertion pieces via said wedge, said apparatus further comprising a bracing part longitudinally spaced from said cylinder, a passage in said bracing part for said wedge, and two tie plates respectively extending on each side of said wedge, said bracing part being rigidly joined to said cylinder by said tie plates, and said insertion pieces each having a flat end face at the end thereof remote from said cylinder said end faces being braced against said bracing part.

2. An apparatus according to claim 1, further comprising two slide plates, wherein said insertion pieces have a T-shaped cross-section, the upright of said T comprising said inclined portion, and each said slide plate being secured to a respective side of each said upright and displaceably guided along the inside of an adjacent said tie plate.

3. An apparatus according to claim 2, further comprising two stop ledges respectively secured to the inside of each said tie plate, wherein each said insertion piece has a forward end and a rearward end, each said slide plate extending up to a said forward end of the associated said insertion piece and extending toward said rearward end thereof up to a said stop ledge.

* * * * *